US007893885B2

(12) United States Patent
Jung et al.

(10) Patent No.: US 7,893,885 B2
(45) Date of Patent: Feb. 22, 2011

(54) ANTENNA SYSTEM FOR TRACKING MOBILE SATELLITE AND CARRIER HAVING THE SAME

(75) Inventors: Young-Bae Jung, Daejon (KR); Soon-Ik Jeon, Daejon (KR); Chang-Joo Kim, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 195 days.

(21) Appl. No.: 12/096,394

(22) PCT Filed: Oct. 12, 2006

(86) PCT No.: PCT/KR2006/004101

§ 371 (c)(1),
(2), (4) Date: Jun. 6, 2008

(87) PCT Pub. No.: WO2007/066885

PCT Pub. Date: Jun. 14, 2007

(65) Prior Publication Data

US 2008/0297426 A1 Dec. 4, 2008

(30) Foreign Application Priority Data

Dec. 8, 2005 (KR) ..... 10-2005-0119630
May 19, 2006 (KR) ..... 10-2006-0045213

(51) Int. Cl.
*H01Q 3/00* (2006.01)

(52) U.S. Cl. ..... 343/765; 343/757; 343/766

(58) Field of Classification Search ..... 343/757, 343/765, 766
See application file for complete search history.

(56) References Cited

U.S. PATENT DOCUMENTS 5,419,521 A 5/1995 Matthews
6,195,060 B1 * 2/2001 Spano et al. ..... 343/766
6,204,823 B1 3/2001 Spano et al.

(Continued)

FOREIGN PATENT DOCUMENTS

JP 07-263939 10/1995

(Continued)

OTHER PUBLICATIONS

Kazuo Sato, et al; "Development and Field Experiments of Phased Array Antenna for land Vehicle Satellite Communications," Antennas and Propagation Society International Symposium, pp. 1073-1076, 1992.

(Continued)

*Primary Examiner*—Hoang V Nguyen
(74) *Attorney, Agent, or Firm*—Ladas & Parry LLP

(57) ABSTRACT

Provided is a antenna system for tracking a mobile satellite and a movable carrier having the same for mechanically adjusting the orientation of an antenna at the azimuth angle and the elevation angle and correcting the phase error of a receiving signal while adjusting the elevation angle of the antenna at the same time. The antenna system for tracking a mobile satellite includes: a substrate; a rotating plate rotatably disposed on the substrate; one or more antennas disposed at the rotating plate; an azimuth angle adjusting unit for mechanically adjusting an azimuth angle of the antenna; and an elevation angle adjusting unit for mechanically adjusting an elevation angle of the antenna.

8 Claims, 4 Drawing Sheets

U.S. PATENT DOCUMENTS

| | | | | |
|---|---|---|---|---|
| 6,259,415 | B1 * | 7/2001 | Kumpfbeck et al. | 343/765 |
| 6,738,024 | B2 | 5/2004 | Butler et al. | |
| 6,839,039 | B2 | 1/2005 | Tanaka et al. | |
| 6,952,587 | B2 | 10/2005 | Whikehart et al. | |
| 6,999,036 | B2 * | 2/2006 | Stoyanov et al. | 343/765 |
| 7,385,562 | B2 * | 6/2008 | Stoyanov et al. | 343/765 |

FOREIGN PATENT DOCUMENTS

| | | |
|---|---|---|
| KR | 1992-0010206 | 11/1992 |
| KR | 1020010031359 | 4/2001 |
| KR | 1020010096090 | 11/2001 |

OTHER PUBLICATIONS

International Search Report mailed Jan. 23, 2007; PCT/KR2006/004101.

* cited by examiner

[Fig. 1]
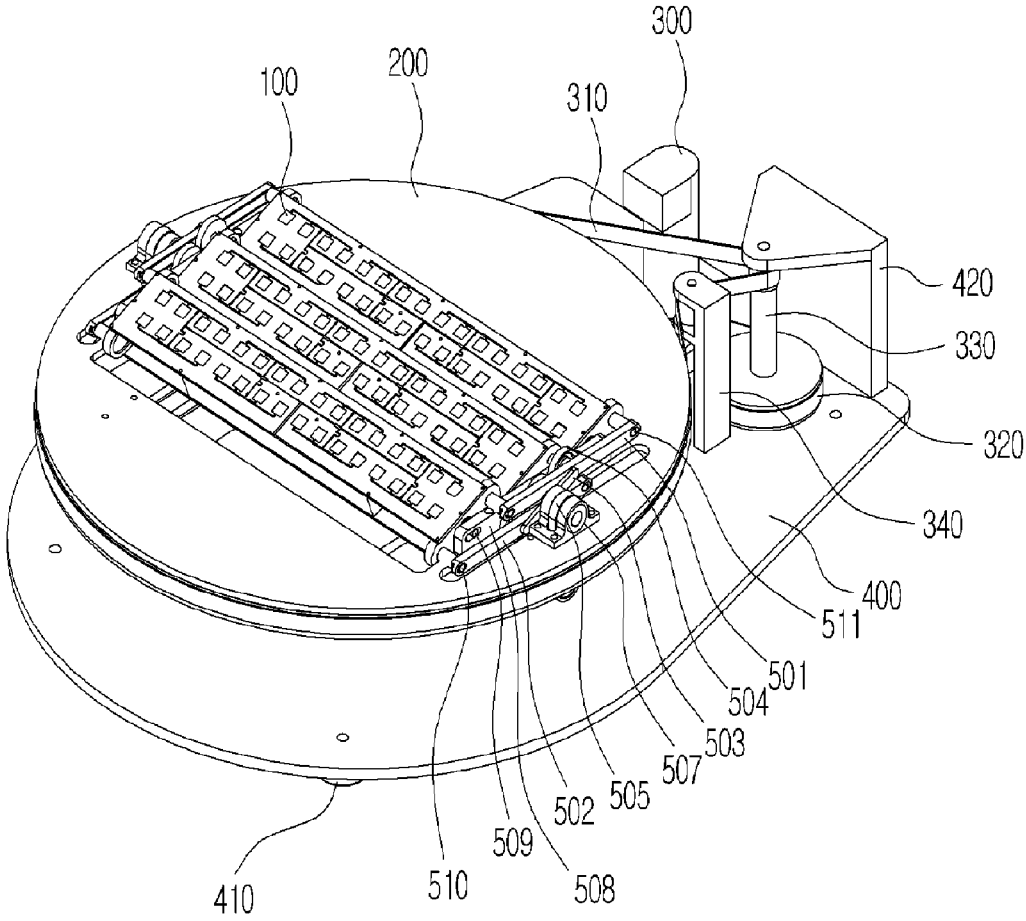
[Fig. 2]
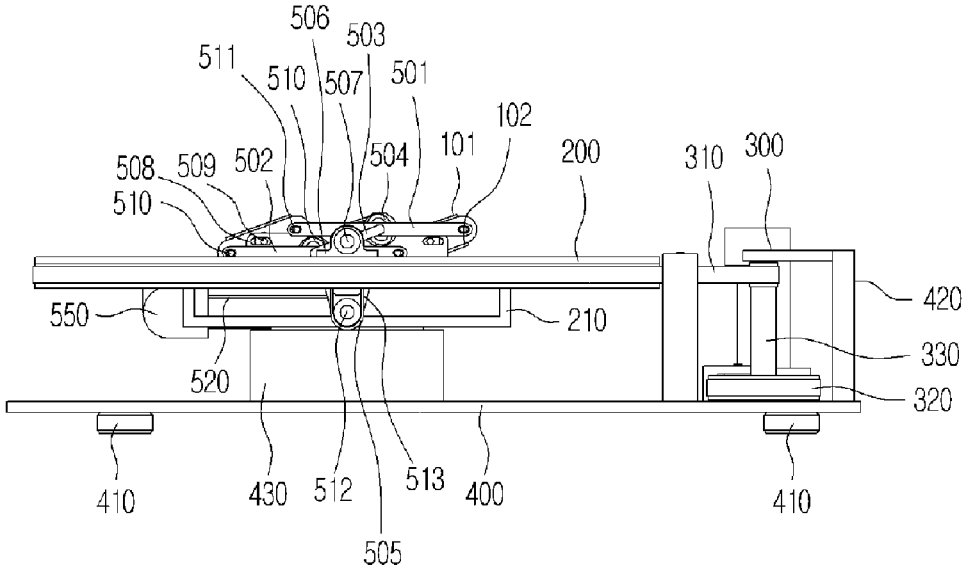

[Fig. 3]
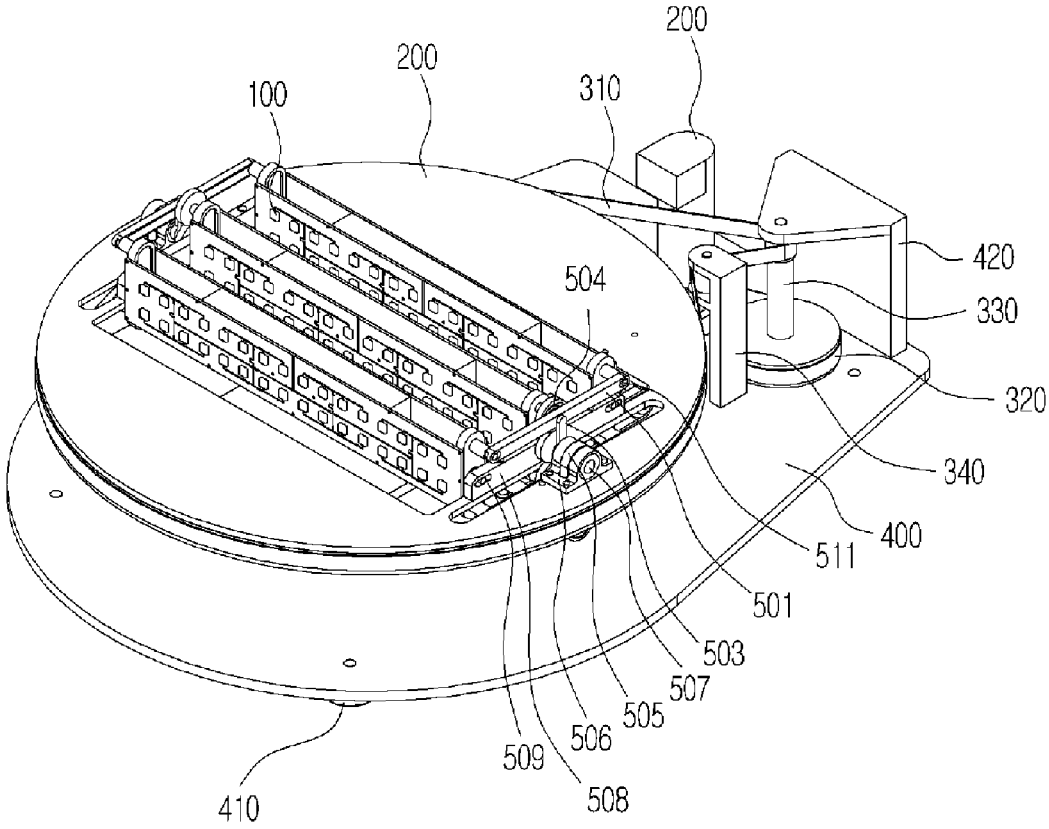
[Fig. 4]
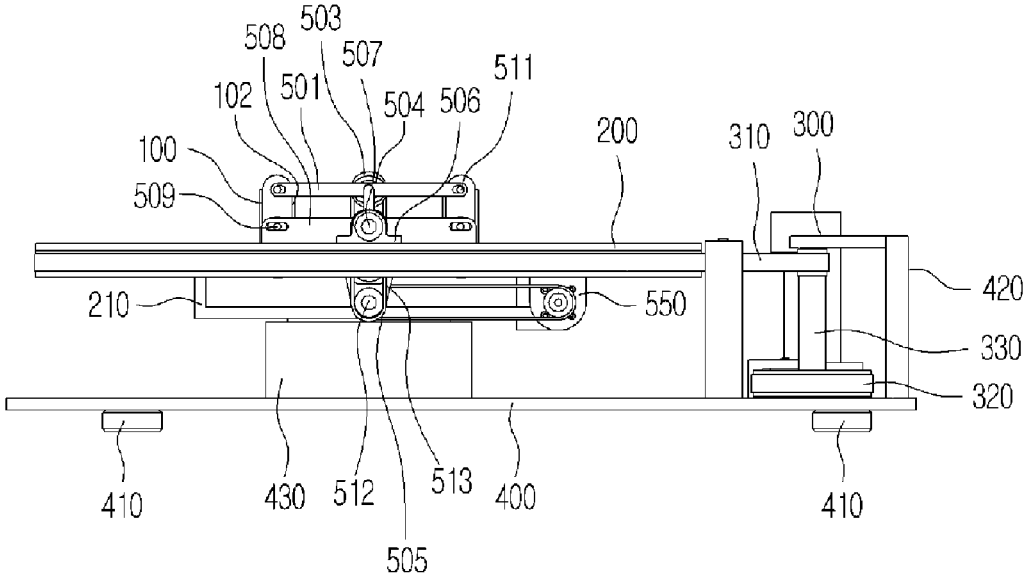

[Fig. 5]
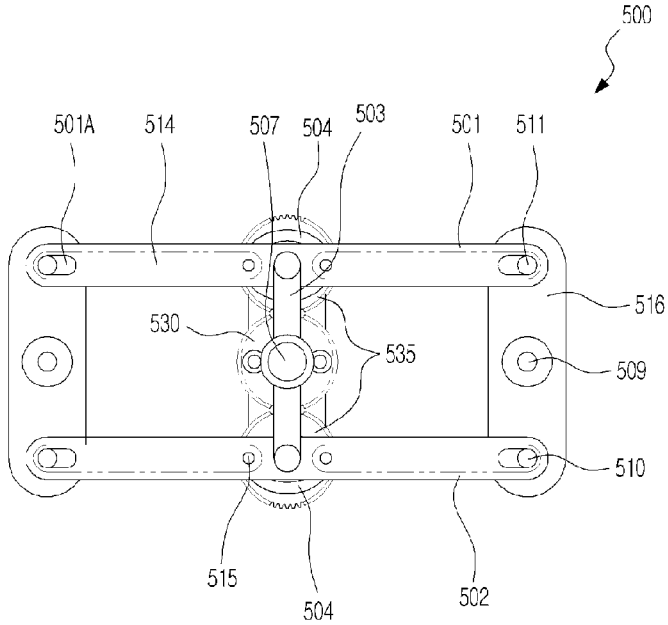
[Fig. 6]
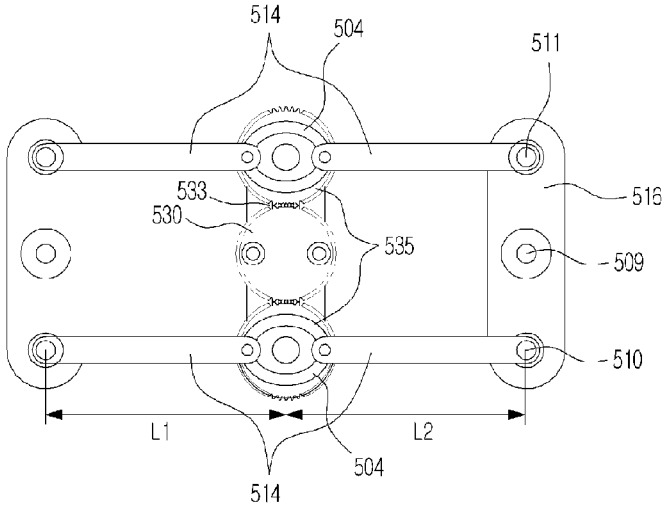
[Fig. 7]
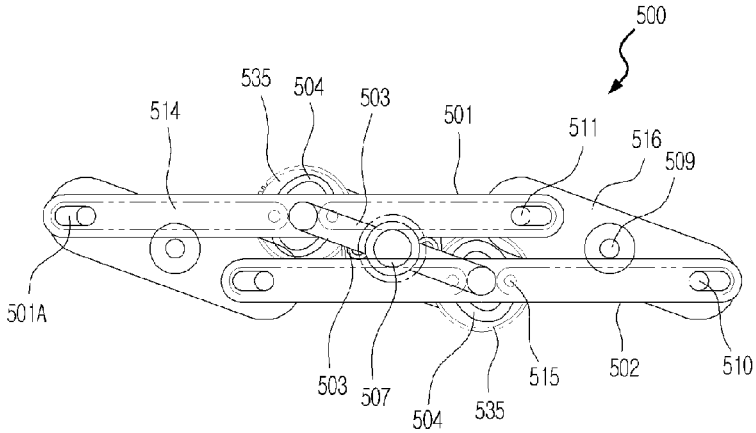

[Fig. 8]
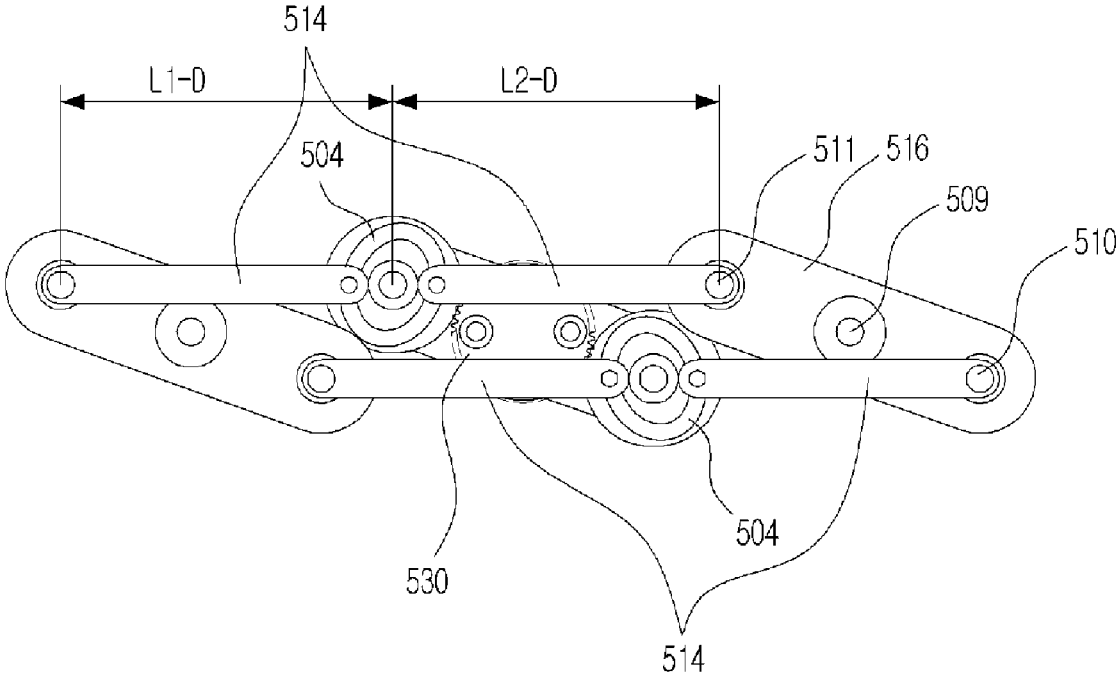

ANTENNA SYSTEM FOR TRACKING MOBILE SATELLITE AND CARRIER HAVING THE SAME

TECHNICAL FIELD

The present invention relates to a antenna system for tracking a mobile satellite and a movable carrier having the same; and more particularly, to a antenna system for tracking a mobile satellite and a movable carrier having the same for mechanically adjusting the orientation of an antenna at the azimuth angle and the elevation angle and correcting the phase error of a receiving signal while adjusting the elevation angle of the antenna at the same time.

BACKGROUND ART

A conventional mobile satellite antenna system requires a proper satellite tracking unit for adjusting the orientation of an antenna in a satellite direction for receiving signals from a satellite with the conventional mobile satellite antenna system mounted at a movable carrier. In order to adjusting the orientation of the antenna, the conventional mobile satellite antenna system generally has an electrical adjusting structure that includes a plurality of antennas, an active channel connected to the plurality of the antennas and including a phase shifter for forming a transmitting and receiving beam, and an additional active channel having an additional phase shifter for forming and adjusting a satellite tracking beam.

However, the electrical adjusting structure of the mobile satellite antenna system requires a high manufacturing cost and an expensive maintenance cost due to expensive parts such as a phase shifter. Since the electrical adjusting structure of the mobile satellite antenna system is complicated, there are many difficulties arisen to manufacture the mobile satellite antenna system. Furthermore, it takes such a long time to manufacture the mobile satellite antenna system.

Also, the electrical adjusting-type mobile satellite antenna system requires complicate mechanism for diagnosing and maintaining each of parts and functions when the electrical adjusting-type mobile satellite antenna system generates errors or becomes malfunctioned. Especially, the structure of the electrical adjusting-type mobile satellite antenna system becomes more seriously complicated for accurately adjusting the orientation of the beam and removing the phase error of receiving signal.

DISCLOSURE OF INVENTION

Technical Problem

It is, therefore, an object of the present invention to provide a antenna system for tracking a mobile satellite and a movable carrier having the same for mechanically adjusting the orientation of an antenna independently at the azimuth angle and the elevation angle, simultaneously correcting the phase error of a receiving signal while adjusting the elevation angle of the antenna, requiring a less cost for manufacturing, fixing and maintaining the antenna system compared to an electrical-adjusting type satellite tracking system, and having the optimal function and structure for mechanically adjusting the antenna.

Technical Solution

In accordance with one aspect of the present invention, there is provided a antenna system for tracking a mobile satellite including: a substrate; a rotating plate rotatably disposed on the substrate; one or more antennas disposed at the rotating plate; an azimuth angle adjusting unit for mechanically adjusting an azimuth angle of the antenna; and an elevation angle adjusting unit for mechanically adjusting an elevation angle of the antenna.

ADVANTAGEOUS EFFECTS

A antenna system for tracking a mobile satellite according to the present invention includes an azimuth angle adjusting unit and an elevation angle adjusting unit for adjusting the azimuth angle and the elevation angle of antennas mechanically and independently. Also, the antenna system for tracking a mobile satellite according to the present invention adjusts the distance between the antennas while adjusting the elevation angle of the antenna through an elevation angle driving links. Furthermore, the antenna system for tracking a mobile satellite according to the present invention compensates the phase error of the receiving signal, which is generated when the elevation angle is adjusted, through the elevation angle driving links. Moreover, the antenna system for tracking a mobile satellite requires a less manufacturing cost compared to an electrical driving type antenna system for tracking a mobile satellite having a plurality of phase shifters through minimizing electric active parts.

Since the antenna system for tracking a mobile satellite according to the present invention has a simpler mechanical structure without phase shifters which are required for electrical tracking scheme, the reliability of the antenna system for tracking a mobile satellite is improved. Accordingly, the maintenance cost thereof is reduced.

BRIEF DESCRIPTION OF THE DRAWINGS

The above and other objects and features of the present invention will become apparent from the following description of the preferred embodiments given in conjunction with the accompanying drawings, in which:

FIG. 1 is a perspective view of a antenna system for tracking a mobile satellite in accordance with an embodiment of the present invention;

FIG. 2 is a side view of FIG. 1;

FIG. 3 is a perspective view of the mobile satellite tracing antenna system shown in FIG. 1 which is adjusted at an azimuth angle and an elevation angle;

FIG. 4 is a side view of FIG. 3;

FIG. 5 is a view showing the connection of an elevation angle driving links in accordance with an embodiment of the present invention;

FIG. 6 is a view showing a driving mechanism of an elevation angle driving links in accordance with an embodiment of the present invention;

FIG. 7 shows the elevation angle driving unit of FIG. 5 at the elevation angle; and FIG. 8 shows the view of FIG. 6 controlled at the elevation angle.

BEST MODE FOR CARRYING OUT THE INVENTION

Other objects and aspects of the invention will become apparent from the following description of the embodiments with reference to the accompanying drawings, which is set forth hereinafter.

FIG. 1 is a perspective view of a mobile satellite antenna system in accordance with an embodiment of the present invention, FIG. 2 is a side view of FIG. 1, FIG. 3 is a perspective view of the mobile satellite tracing antenna system shown in FIG. 1, which is adjusted at an azimuth angle and an elevation angle, and FIG. 4 is a side view of FIG. 3.

As shown in FIGS. 1 and 2, the mechanical-adjusting type mobile satellite antenna system according to the present embodiment includes a substrate 400, a rotating plate 200, antennas 100, an azimuth angle adjusting unit, and an elevation angle adjusting unit.

The substrate 400 is a main body that houses the rotating plate 200, the antenna 100, the azimuth angle control unit and the elevation angle control unit. The substrate 400 includes a substrate supporting plate 410 coupled to the bottom of the substrate 400 for horizontally sustaining and preventing the substrate 400 from being vibrated, and a rotating plate supporting unit 430 rotatably coupled to the supporting plate 400 to allow the rotating plate 200 to rotate and including a rotating supporting unit such as a shaft-bearing at the top surface thereof in order to allow smooth rotation of the rotating plate 200.

The rotating plate 200 has a disk shape and houses the antennas 100 and the elevation angle adjusting unit. The rotating plate 200 includes a groove around the circumference of the rotating plate 200 for disposing an azimuth angle adjusting belt 310 therein. Furthermore the rotating plate 200 may include a rotating plate frame unit 210 rotatably coupled at the bottom thereof for supporting the entire rotating plate 200.

The antenna 100 is a plate shaped member including a plurality of radiation elements. Two of antennas as a set are disposed on the rotating plate 200 for transmitting and receiving communication signals including broadcasting signal and satellite signals.

The azimuth angle adjusting unit is disposed on the substrate 400 and includes a motor such as a stepping motor for fine adjustment, a driving shaft and a poly. The azimuth angle adjusting unit includes an azimuth angle driving motor 300 and an azimuth angle driving belt 310. The azimuth angle driving motor 300 generates the power to rotate the rotating plate 200 in response to a driving signal for adjusting an azimuth angle of the antennas regarding to satellite positioning information obtained through analyzing the intensity of a receiving signal using a sensor, such as a gyroscope sensor, and a control unit (not shown). The azimuth angle driving belt 310 transfers the generated power to the rotating plate 200. The azimuth angle driving belt 310 may directly connected to the rotating plate 200.

It is preferable that the azimuth angle adjusting unit may further include a poly 300, a sub substrate 420 and a control unit 340. The poly 300 includes one end connected to the rotating plate 200 through the azimuth angle driving belt 310. The one end of the poly 300 has a smaller diameter than the other end for increasing the torque of the rotating power generated from the azimuth angle driving motor 300 and for decelerating. The poly 300 also includes the other end connected to the azimuth angle driving motor 300 through the azimuth angle driving belt 320 for transferring the rotating power. The sub substrate 420 stably supports the both ends of the poly 330. The control unit 340 controls the tension of the azimuth angle driving belt 320. The azimuth angle adjusting unit finely controls the group of the antennas 100 in a range of 360 with the vertical central shaft of the rotating plate 200 as a center in order to control the antenna system according to the motion of a mobile carrier.

As shown in FIGS. 3 and 4, the elevation angle adjusting unit includes a motor having a stepping motor for fine adjustment, a driving shaft, and a poly, which are disposed at the bottom of the rotating plate 200. Selectively, the elevation angle adjusting unit includes an elevation angle driving motor 550, a pair of elevation angle driving links 500, and an elevation angle driving belt 520. The elevation angle driving motor 550 generates the driving power of the antenna in response to a driving signal for adjusting the elevation angle regarding to satellite positioning information obtained through analyzing the intensity of a receiving signal using a sensor, such as a gyroscope sensor, and a control unit. The pair of elevation angle driving links 500 is connected to the both ends of a plurality of antennas 100 to be connected to the plurality of antennas 100 at the same time for transferring the generated driving force to the antenna 100 to drive the antennas 100 at the elevation angle. The elevation angle driving belt 520 directly transfers the driving force to the elevation angle driving links 500.

It is preferable that the elevation angle driving unit may further include a bottom shaft 512, and a top shaft 507. The bottom shaft 512 is disposed at the bottom of the rotating plate 200 and is supported by a bottom supporting member 513. Also, the bottom shaft 512 is connected to the elevation angle driving motor 550 through the elevation angle driving belt 520. The top shaft 507 is disposed at the top of the rotating plate 200 and supported by a top supporting member 506. The elevation angle adjusting unit finely adjusts the group of antennas 100 to direct in the elevation angle according to the motion of the mobile carrier.

FIG. 5 is a view showing the connection of an elevation angle driving links in accordance with an embodiment of the present invention, and FIG. 6 is a view showing a driving mechanism of an elevation angle driving links in accordance with an embodiment of the present invention. FIG. 7 shows the elevation angle driving unit of FIG. 5 at the elevation angle, and FIG. 8 shows the view of FIG. 6 controlled at the elevation angle.

As shown in FIGS. 3, 5 and 6, the elevation angle driving links 500 includes a pair of antenna coupling plates 516, a pair of horizontal coupling rods 501 and 502, a vertical coupling rod 503 and a link supporting member 508.

At the antenna coupling plate 516, a central shaft 509 is formed to be externally projected from the center thereof, and a pair of side shafts 510 and 511 is disposed to be externally projected from the both of sides thereof. The pair of the horizontal coupling rods 501 and 502 has a plurality of holes 501A corresponding to the side shafts 510 and 511, and is rotatably connected to the coupling plates 516 by inserting each of the side shafts 510 and 511 through the holes 510A. The top shaft 507 is connected to the center of the vertical coupling rod 503, and axially connects the horizontal coupling rod 501 disposed above the top shaft 507 and the horizontal coupling rod 502 below the top shaft 507. The link supporting member 508 is connected to the rotating plate 200 and includes a hole corresponding to the central shaft 509. The link supporting member 508 is supported by the central shaft 509 which is inserted into the hole of the supporting member 508. The plurality of antennas 100 may move in the same angle by the rotation of the top shaft 507.

It is preferable that the elevation adjusting link 500 may further include a fixing member 503 fixed at the link supporting member 508 and having a gear 500 formed along the circumference thereof, a rotating member 535 having a gear 533 formed along the circumference thereof to be coupled to the fixing member 530 and having a cam-groove formed at an oval opened side, and a horizontal coupling bar 514 connecting the side shafts 510 and 511 horizontally through inserting a cam shaft 515 formed at the one end thereof into the cam-groove 504 and axially connecting the other end thereof to the side shaft 511. According to the elevation angle adjustment of the antenna coupling plate 516, the gap between the antennas 100 is also adjusted.

FIGS. 6 and 8 show the elevation adjusting link unit 500 without the vertical coupling rod 503 and the horizontal coupling rod 502 for showing the driving mechanism of adjusting the elevation angle and the gaps of the antennas 100 at the same time.

Herein, L1 and L2 denote lengths of marked portions. They are mathematically identical. 'd' denotes a distance from the cam shaft 515 to the center of the rotating member 535 in FIG. 5, and 'd' denotes a distance from the cam shaft 515 to the center of the rotating member 535.

That is, the antenna system for tracking a mobile satellite according to the present embodiment can mechanically adjust the distance between the antennas 100 to be lengthened or be shortened when the elevation angle of the antenna 100 is adjusted through the shape of the oval cam groove 504. Therefore, the antenna system for tracking a mobile satellite according to the present embodiment can mechanically compensate the phase error of a receiving signal, which may be distorted when the elevation angle of the antenna is adjusted. Also, the antenna system for tracking a mobile satellite according to the present invention can adjust the azimuth angle and the elevation angle independently through the mechanical adjustment by including the azimuth angle adjusting unit and the elevation angle adjusting unit.

In the present embodiment, three antenna groups 100 each having two antennas are disposed. However, the present invention is not limited thereby. More antennas may be included by arranging the antennas as shown in the present embodiment and horizontally coupling the antennas through the horizontal coupling rods 501 and 502. In the present invention, belts are used to transfer the driving power for controlling the azimuth angle and the elevation angle. However, the present invention is not limited thereby. That is, the mechanical adjusting-type antenna system for tracking a mobile satellite according to the present invention may transfer the driving power using various gears or links.

Also, the mechanical adjusting-type antenna system for tracking a mobile satellite according to the present invention may be used to stably transmit and receive communication signals with mounted at various mobile carriers such as automobiles, trains, ships and air-planes.

The present application contains subject matter related to Korean patent application No. 2005-0119630, filed in the Korean Intellectual Property Office on Dec. 8, 2005, and Korean patent application No. 2006-0045213, filed in the Korean Intellectual Property Office on May 19, 2006, the entire contents of which is incorporated herein by reference.

While the present invention has been described with respect to certain preferred embodiments, it will be apparent to those skilled in the art that various changes and modifications may be made without departing from the scope of the invention as defined in the following claims.

The invention claimed is:

1. An antenna system for tracking a mobile satellite comprising:

a substrate;

a rotating plate rotatably disposed on the substrate;

a plurality of antennas disposed at the rotating plate;

an azimuth angle adjusting unit for mechanically adjusting an azimuth angle of the antenna; and an elevation angle adjusting unit for mechanically adjusting an elevation angle of the antennas while simultaneously adjusting the distance between the antennas, the elevation angle adjusting unit comprising a pair of elevation angle driving links connected to opposing ends of the plurality of antennas in order to simultaneously connect the plurality of antennas in a manner such that the elevation angle and the distance between antennas are simultaneously adjusted.

2. The antenna system for tracking a mobile satellite as recited in claim 1, wherein the elevation angle driving link includes:

a plurality of antenna coupling plates having a central shaft externally projected from a center thereof, and a pair of side shafts externally projected from both sides thereof in which the antennas are coupled;

a pair of horizontal coupling rods having holes corresponding to the side shafts for rotatably coupling the plurality of antenna coupling plates with the side shafts inserted into the holes of the horizontal coupling rods;

a vertical coupling rod having a center portion connected to the top shaft and both ends axially coupled to the pair of the horizontal coupling rods; and a link supporting member connected to the rotating plate and having a hole corresponding to the central shaft to receive the central shaft, wherein the elevation angle driving link allows the plurality of antennas to rotate at the same angle by the rotation of the central shaft.

3. An antenna system for tracking a mobile satellite comprising:

a substrate;

a rotating plate rotatably disposed on the substrate;

a plurality of antennas disposed at the rotating plate;

an azimuth angle adjusting unit for mechanically adjusting an azimuth angle of the antenna; and an elevation angle adjusting unit for mechanically adjusting an elevation angle of the-antennas while simultaneously adjusting the distance between the antennas, wherein the azimuth angle adjusting unit includes:

an azimuth angle driving motor disposed at the substrate for generating a rotating power of the rotating plate; and an azimuth angle driving belt for transferring the rotating power to the rotating plate.

4. An antenna system for tracking a mobile satellite comprising:

a substrate;

a rotating plate rotatably disposed on the substrate;

one or more antennas disposed at the rotating plate an azimuth angle adjusting unit for mechanically adjusting an azimuth angle of the antenna; and an elevation angle adjusting unit for mechanically adjusting an elevation angle of the antenna, wherein the-azimuth angle adjusting unit includes:

an azimuth angle driving motor disposed at the substrate for generating a rotating power of the rotating plate;

an azimuth angle driving belt for transferring the rotating power to the rotating plate;

a poly having one end connected to the rotating plate through a belt, which has a smaller diameter than the other end, for increasing the torque of the rotating power to decelerate, and the other end connected to the azimuth angle driving motor through a belt;

a sub substrate disposed at the substrate for stably supporting the poly; and a control unit disposed at the substrate for controlling a tension of the azimuth angle driving belt.

5. An antenna system for tracking a mobile satellite comprising:

a substrate;

a rotating plate rotatably disposed on the substrate;

one or more antennas disposed at the rotating plate an azimuth angle adjusting unit for mechanically adjusting an azimuth angle of the antenna; and an elevation angle adjusting unit for mechanically adjusting an elevation angle of the antenna, wherein the elevation angle driving unit includes:

an elevation angle driving motor disposed at the rotating plate for generating a driving power;

a pair of elevation angle driving links connected to both ends of the plurality of antennas in order to simultaneously connect the plurality of antennas for transforming the driving power to drive the antenna in the elevation angle;

an elevation angle driving belt for transferring the driving power to the elevation angle driving link;

a bottom shaft disposed at the bottom of the rotating plate, supported by a bottom supporting member, and connected to the elevation angle driving motor through a belt; and a top shaft disposed above the rotating plate, supported by a top supporting member, connected to the bottom shaft through a belt, and operated with the elevation angle driving link.

6. The antenna system for tracking a mobile satellite as recited in claim 5, wherein the elevation angle driving link includes:

a plurality of antenna coupling plates having a central shaft externally projected from a center thereof, and a pair of side shafts externally projected from both sides thereof in which the antennas are coupled;

a pair of horizontal coupling rods having holes corresponding to the side shafts for rotatably coupling the plurality of antenna coupling plates with the side shafts inserted into the holes of the horizontal coupling rods;

a vertical coupling rod having a center portion connected to the top shaft and both ends axially coupled to the pair of the horizontal coupling rods; and a link supporting member connected to the rotating plate and having a hole corresponding to the central shaft to receive the central shaft, wherein the elevation angle driving link allows the plurality of antennas to rotate at the same angle by the rotation of the central shaft.

7. The antenna system for tracking a mobile satellite as recited in claim 6, wherein the elevation angle driving link includes:

a fixing member fixed at the link supporting member and having a gear formed along a circumference thereof;

a rotating member having an oval cam groove at an opened side thereof, and a gear formed along the circumference to be coupled to the fixing member; and a horizontal coupling bar horizontally connecting the adjacent side shafts and having one end inserted into the cam groove and the other end axially coupled to the side shafts, wherein the elevation angle driving link allows a distance between antennas to be simultaneously adjusted when adjusting the elevation angle of the antenna coupling plate.

8. A movable carrier comprising:

a substrate;

a rotating plate rotatably disposed on the substrate;

a plurality of antennas disposed at the rotating plate;

an azimuth angle adjusting unit for mechanically adjusting an azimuth angle of the antenna; and an elevation angle adjusting unit for mechanically adjusting an elevation angle of the antennas while simultaneously adjusting the distance between the antennas, the elevation angle adjusting unit comprising a pair of elevation angle driving links connected to opposing ends of the plurality of antennas in order to simultaneously connect the plurality of antennas in a manner such that the elevation angle and the distance between antennas are simultaneously adjusted, wherein the movable carrier is one of automobile, train, ship and air plane.

* * * * *